US009929527B2

(12) United States Patent
Dai et al.

(10) Patent No.: US 9,929,527 B2
(45) Date of Patent: Mar. 27, 2018

(54) RIGHT ANGLE COAXIAL CABLE AND CONNECTOR ASSEMBLY AND METHOD OF FORMING SAME

(71) Applicant: CommScope Technologies LLC, Hickory, NC (US)

(72) Inventors: Yujun Dai, Suzhou (CN); James P. Fleming, Orland Park, IL (US); ChuanHui Liu, Suzhou (CN); Yujun Zhang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 9 days.

(21) Appl. No.: 15/071,680

(22) Filed: Mar. 16, 2016

(65) Prior Publication Data

US 2016/0276755 A1 Sep. 22, 2016

Related U.S. Application Data

(60) Provisional application No. 62/133,611, filed on Mar. 16, 2015.

(51) Int. Cl.

| | |
|---|---|
| ***H01R 9/05*** | (2006.01) |
| ***H01R 43/02*** | (2006.01) |
| *H01R 24/40* | (2011.01) |

(52) U.S. Cl.

CPC ..... *H01R 43/02* (2013.01); *H01R 24/40* (2013.01)

(58) Field of Classification Search

CPC ..... H01R 24/40; H01R 43/02

(Continued)

(56) References Cited

U.S. PATENT DOCUMENTS 2,152,504 A * 3/1939 Scott ..... H01R 24/40 174/19
4,049,902 A * 9/1977 de Ronde ..... H01R 9/05 174/359

(Continued)

FOREIGN PATENT DOCUMENTS

| | | |
|---|---|---|
| JP | 2005 174886 | 6/2005 |
| JP | 2008 098125 | 4/2008 |

OTHER PUBLICATIONS

International Search Report and Written Opinion for corresponding PCT Application No. PCT/US2016/022589, dated Jun. 30, 2016, 11 pages.

(Continued)

*Primary Examiner* — Abdullah Riyami
*Assistant Examiner* — Nelson R Burgos-Guntin
(74) *Attorney, Agent, or Firm* — Myers Bigel, P.A.

(57) ABSTRACT

A method of induction soldering an inner conductor of a coaxial cable to an inner contact of a right angle coaxial connector includes: (a) providing a coaxial connector, the coaxial connector including an outer conductor body and an inner contact, the inner contact defining a mating axis, the inner contact further comprising a blind hole with an open end; (b) providing a coaxial cable, the coaxial cable including an inner conductor, a dielectric circumferentially surrounding the inner conductor, and an outer conductor circumferentially surrounding the dielectric; (c) inserting the coaxial cable into the coaxial connector such that an end of the inner conductor is positioned in the blind hole of the inner contact and perpendicular to the mating axis; and (d) heating the blind hole of the inner conductor to melt solder present in the blind hole to form a solder joint between the inner conductor and the inner contact.

6 Claims, 6 Drawing Sheets

(58) Field of Classification Search
USPC ..... 439/582
See application file for complete search history.

(56) References Cited

U.S. PATENT DOCUMENTS

| | | | | |
|---|---|---|---|---|
| 5,582,665 | A * | 12/1996 | Eigen | B29C 65/18 156/292 |
| 5,961,349 | A * | 10/1999 | Paagman | H01R 23/688 439/607.35 |
| 6,106,333 | A * | 8/2000 | Purdy | H01R 24/547 439/578 |
| 6,287,144 | B1 * | 9/2001 | Baffert | H01R 4/28 439/578 |
| 6,860,761 | B2 | 3/2005 | Lee et al. | |
| 7,458,850 | B1 | 12/2008 | Burris et al. | |
| 7,946,886 | B1 * | 5/2011 | Liu | H01R 4/36 439/582 |
| 8,182,285 | B2 | 5/2012 | Annequin et al. | |
| 8,628,352 | B2 | 1/2014 | Nugent | |
| 8,641,447 | B2 * | 2/2014 | Sykes | H01R 24/44 439/582 |
| 9,362,671 | B2 * | 6/2016 | Vaccaro | |
| 9,385,497 | B2 * | 7/2016 | Paynter | H01R 43/02 |
| 2003/0038129 | A1 * | 2/2003 | Hiramatsu | H01L 21/67103 219/444.1 |
| 2004/0137790 | A1 * | 7/2004 | Lee | H01R 4/28 439/582 |
| 2009/0218530 | A1 * | 9/2009 | Starck | G05D 23/1921 251/11 |
| 2009/0261480 | A1 * | 10/2009 | Martin | H01L 24/64 257/777 |
| 2010/0187205 | A1 * | 7/2010 | Masaki | B23K 3/033 219/85.16 |
| 2012/0021645 | A1 | 1/2012 | Marsh | |
| 2012/0214341 | A1 * | 8/2012 | Huang | H01R 13/5202 439/583 |
| 2013/0025121 | A1 * | 1/2013 | Van Swearingen | B23K 20/129 29/874 |
| 2014/0377990 | A1 * | 12/2014 | Saller | H01R 24/38 439/582 |
| 2015/0118898 | A1 | 4/2015 | Paynter et al. | |
| 2016/0111798 | A1 * | 4/2016 | Wu | H01R 4/183 439/391 |
| 2016/0226161 | A1 * | 8/2016 | Zhang | H01R 9/0503 |
| 2016/0276755 | A1 * | 9/2016 | Dai | H01R 43/02 |

OTHER PUBLICATIONS

Notification Concerning Transmittal of International Preiiminary Report on Patentability for corresponding PCT Application No. PCT/US2016/022589, dated Sep. 28, 2017.

* cited by examiner

RIGHT ANGLE COAXIAL CABLE AND CONNECTOR ASSEMBLY AND METHOD OF FORMING SAME

RELATED APPLICATION

The present application claims priority from and the benefit of U.S. Provisional Patent Application No. 62/133,611, filed Mar. 16, 2015, the disclosure of which is hereby incorporated herein in its entirety.

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric that separates the inner and outer conductors, and a jacket that covers the outer conductor. Coaxial cable connectors may be applied to the terminal of the coaxial cables, for example, in communication systems requiring a high level of precision and reliability.

Coaxial cable connector is a functional device that provides functionality ensuring communication connection/disconnection between the device and cable to which it is connected and another cable. One end of its interface is used to (a) connect the cable required to be connected, while the opposing end is used to (b) mount the connector on the device or on another cable. Typically, a connector will include an inner conductor, an outer conductor body, and a mechanism ensuring electric coupling of the connector, such as a threaded coupling nut.

Although many coaxial connectors are "in line" with the cable to which they are attached (i.e., the conductors of the cable are generally parallel with the inner contact part of the connector and, therefore, with the mating direction of the connector), "right angle" coaxial connectors exist in which the inner contact part of the connector is generally perpendicular to the conductors of the cable. Exemplary right angle connectors are discussed in U.S. Pat. Nos. 6,860,761; 7,458,850; 8,182,285; and 8,628,352, the disclosures of which are hereby incorporated herein in their entireties.

Passive Intermodulation Distortion (PIM) is a form of electrical interference/signal transmission degradation that may occur with less than symmetrical interconnections and/or as electro-mechanical interconnections shift or degrade over time. Interconnections may shift due to mechanical stress, vibration, thermal cycling, and/or material degradation. PIM can be an important interconnection quality characteristic, as PIM generated by a single low quality interconnection may degrade the electrical performance of an entire Radio Frequency system. Thus, the reduction of PIM via connector design is typically desirable.

It is desirable to provide techniques for connecting connectors to cable conductors with low PIM and relatively low manufacturing cost.

SUMMARY

As a first aspect, embodiments of the invention are directed to a method of soldering an inner conductor of a coaxial cable to an inner contact of a right angle coaxial connector. The method, comprises the steps of: (a) providing a coaxial connector, the coaxial connector including an outer conductor body and an inner contact, the inner contact defining a mating axis, the inner contact further comprising a blind hole with an open end; (b) providing a coaxial cable, the coaxial cable including an inner conductor, a dielectric circumferentially surrounding the inner conductor, and an outer conductor circumferentially surrounding the dielectric; (c) inserting the coaxial cable into the coaxial connector such that an end of the inner conductor is positioned in the blind hole of the inner contact, the inner conductor being substantially perpendicular to the mating axis; and (d) heating the blind hole of the inner conductor to melt solder present in the blind hole to form a solder joint between the inner conductor and the inner contact.

As a second aspect, embodiments of the invention are directed to a method of attaching an inner conductor of a coaxial cable to an inner contact of a right angle coaxial connector, comprising the steps of: (a) providing a coaxial connector, the coaxial connector including an outer conductor body and an inner contact, the inner contact defining a mating axis, the inner contact further comprising a receptacle; (b) providing a coaxial cable, the coaxial cable including an inner conductor, a dielectric circumferentially surrounding the inner conductor, and an outer conductor circumferentially surrounding the dielectric; (c) lowering the coaxial cable into the coaxial connector such that an end of the inner conductor is positioned in the receptacle of the inner contact, the inner conductor being substantially perpendicular to the mating axis; and (d) heating the receptacle of the inner conductor to melt solder present in the receptacle to form a solder joint between the inner conductor and the inner contact.

As a third aspect, embodiments of the invention are directed to a coaxial cable-connector assembly, comprising: a coaxial connector including an outer conductor body and an inner contact, the inner contact defining a mating axis, the inner contact further comprising a blind hole with an open end; and a coaxial cable, the coaxial cable including an inner conductor, a dielectric circumferentially surrounding the inner conductor, and an outer conductor circumferentially surrounding the dielectric. An end of the inner conductor of the coaxial cable is soldered into the blind hole of the inner contact, the inner conductor being substantially perpendicular to the mating axis.

In some embodiments, the soldering process is an inductive soldering process.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
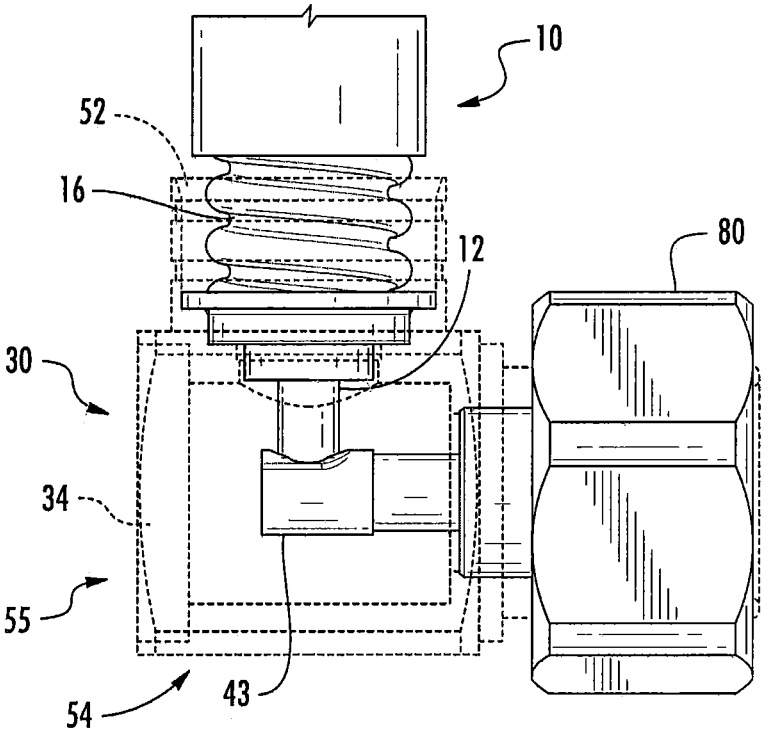
FIG. 1 is a side view of a right-angle cable-connector assembly according to embodiments of the present invention, with the outer conductor body shown in transparent view for clarity.
Figure 2:
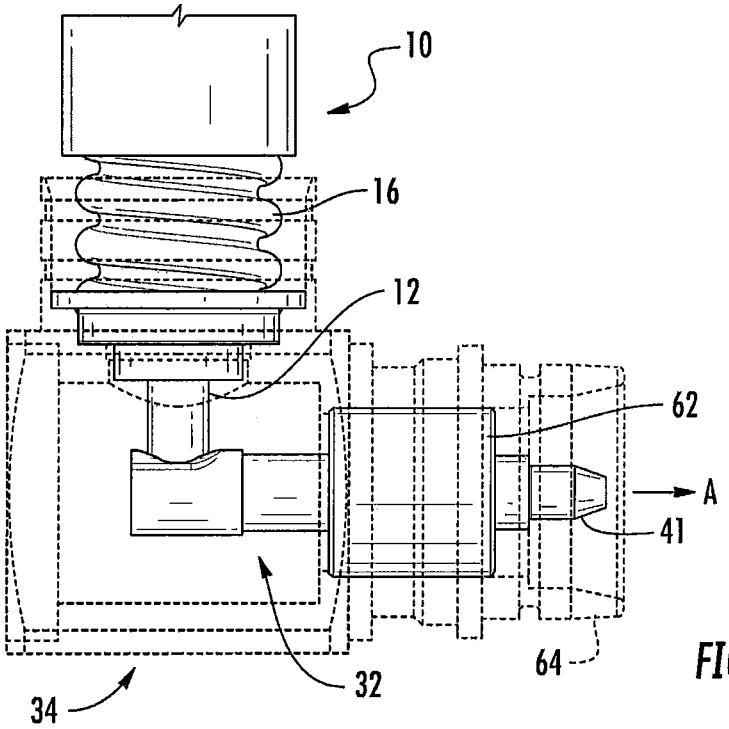
FIG. 2 is a side view of the assembly of FIG. 1 with the coupling nut omitted.

Referring now to the drawings, a right angle connector-cable assembly, designated broadly at 5, is shown in FIGS. 1 and 2. The assembly 5 comprises a coaxial cable 10 and a right angle connector 30, each of which is described in detail below.

Figure 5:
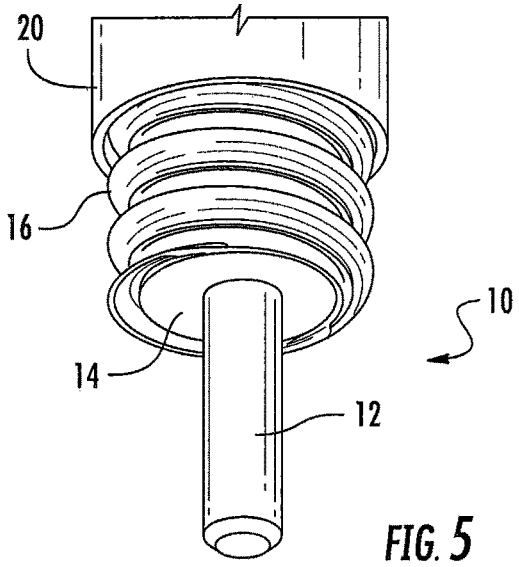
FIG. 5 is a perspective view of the connector end of the inner and outer conductors of the cable of the assembly of FIG. 1.
Figure 6:
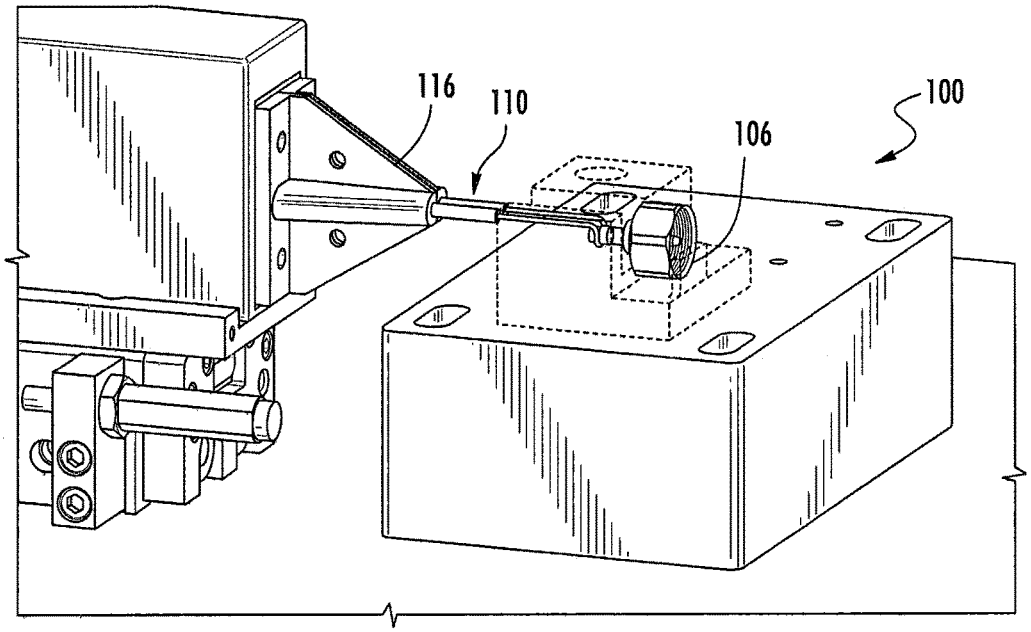
FIG. 6 is a front perspective view of a soldering fixture employed to manufacture the assembly of FIG. 1.

Referring to FIGS. 1, 2 and 5, the coaxial cable 10 includes an inner conductor 12, a dielectric 14 that circumferentially overlies the central conductor 12, an outer conductor 16 that circumferentially overlies the dielectric 14, and a polymeric cable jacket 20 that circumferentially overlies the outer conductor 16. These components will be well-known to those of skill in this art and need not be described in detail herein. The outer conductor 16 is illustrated with a corrugated profile; alternatively, the outer conductor 16 may have a smooth, braided or foil profile. All of these outer conductor configurations are known to those of skill in this art and need not be described in detail herein.

Figure 3:
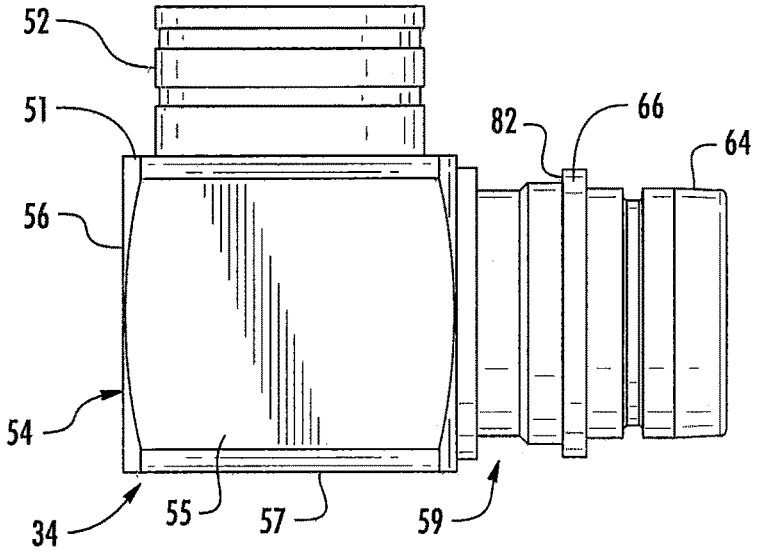
FIG. 3 is a side view of the outer conductor body of the assembly of FIG. 1.
Figure 4:
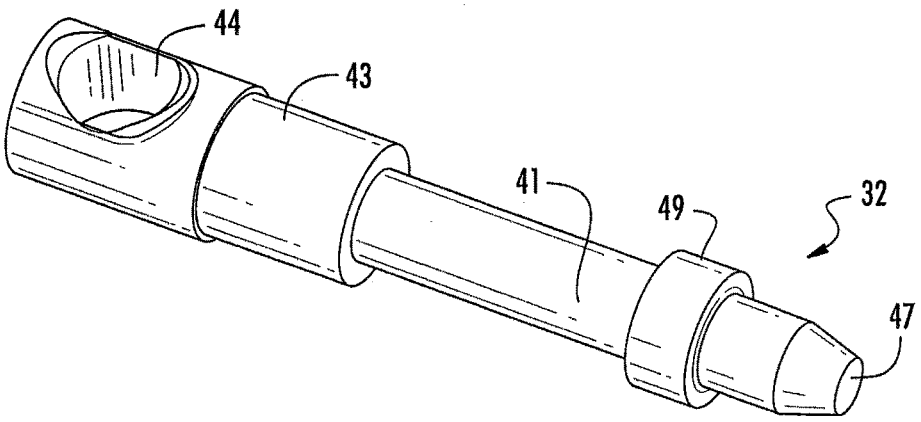
FIG. 4 is a perspective view of the inner contact of the assembly of FIG. 1.

Referring to FIGS. 1-4, the connector 30 includes an inner conductor 32 and an outer conductor body 34. As can be seen in FIG. 4, the inner conductor 32 is generally cylindrical and its contact 41 mates with the female contact section. A step 49 extends radially outwardly from the contact 41 near the contact guide segment 47. A contact block 43 with stepped shape or ether appearance at the root of the contact 41 has an open-ended blind hole 44.

Referring now to FIGS. 1-3, a cable contact sleeve 52 on the outer conductor body 34 includes two grooves 53. A housing section 54 rests atop the cable contact sleeve 52, forming a shoulder 51. The housing section includes side walls 55, a rear wall 56 with an access hole 58 (see FIG. 11), and a ceiling 57. A connector outer conductor contact section 59 extends away from the housing section 54 opposite the rear wall 56. A dielectric 62 (see FIG. 2) fills an inner portion of the connector contact section 59 and maintains physical and electrical separation of the inner conductor 32 and the outer conductor body 34. An annular mating ring 64 extends away from the dielectric 62 and is configured to mate with the female contact section. A circular flange 66 extends radially outwardly from the connector contact section 59 and provides a bearing surface 82 for a coupling nut 80 (FIG. 1) and/or a retaining ring (not shown).

FIGS. 1-3 illustrate the assembled connector 30 and cable 10. The cable contact sleeve 52 of the outer conductor body 34 fits over the outer conductor 16 of the cable 10, with the terminal of the outer conductor 16 establishing an electrical connection with the outer conductor body 34. In some embodiments, this joint is completed via soldering. The inner conductor 12 extends into the cavity of the housing section 54. The blind hole 44 of the contact block 43 of the inner conductor 32 receives the end of the cable inner conductor 12. The inner conductor 32 is attached to the inner conductor 12 of the cable 10 via a soldered joint. The contact 41 of the inner conductor 32 extends through the dielectric 62 and into the space encircled by the mating ring 64. The right angle nature of the connector 30 is thus established by the perpendicular orientation of the contact 41 of the inner conductor 32 and the inner conductor 12 in the housing section 54, with a mating axis A defined by the inner conductor 32 (FIG. 2).

Figure 7:
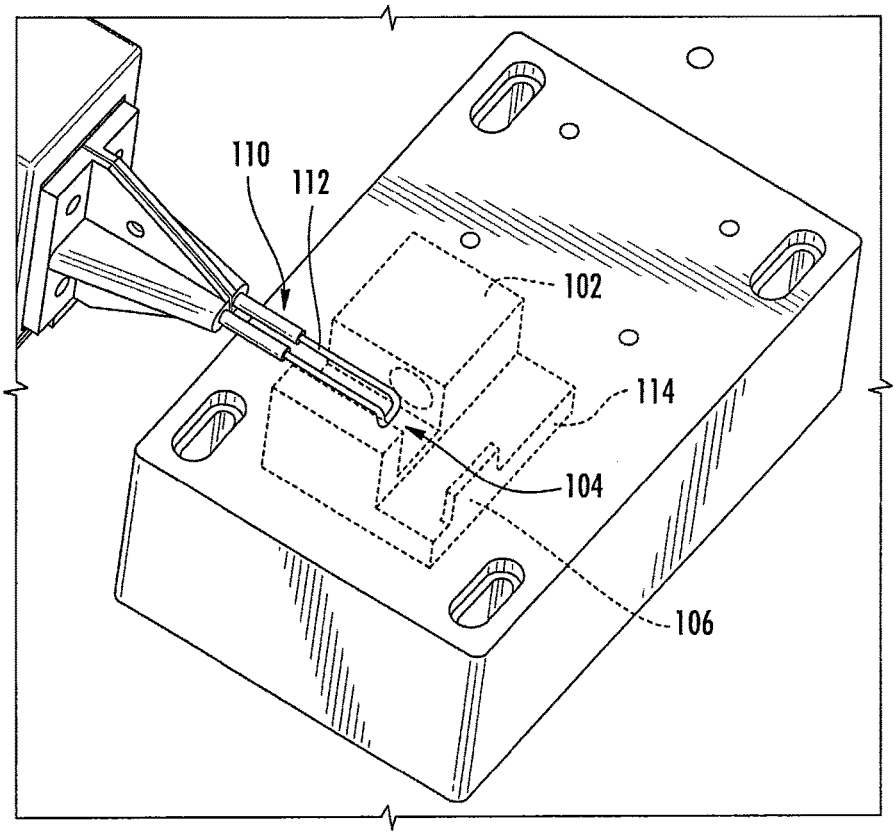
FIG. 7 is a top perspective view of the soldering fixture of FIG. 6.
Figure 8:
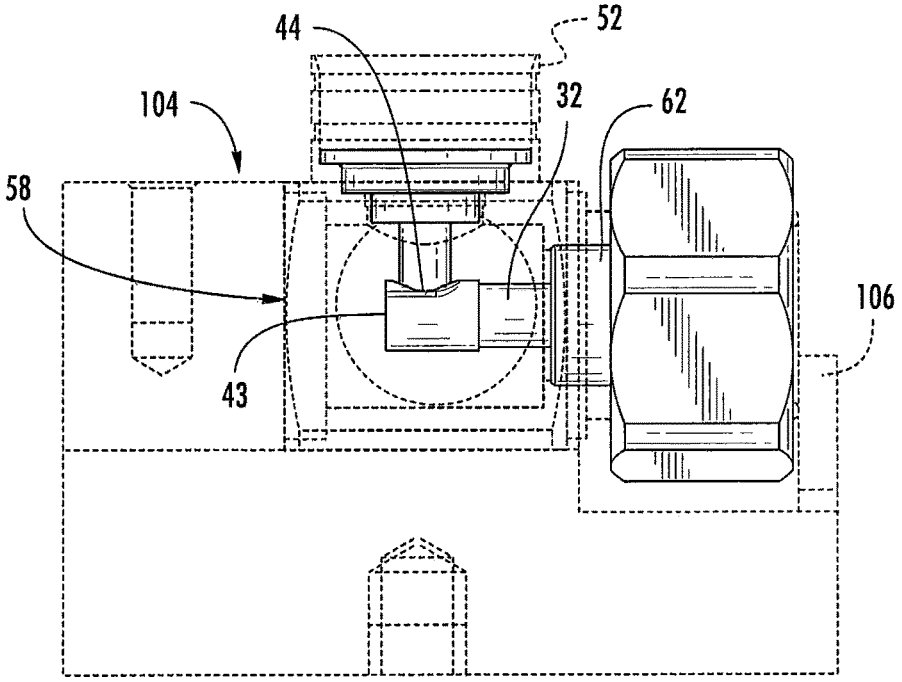
FIG. 8 is a side view of the connector shown in FIG. 1 positioned in the soldering fixture of FIG. 6 with the outer conductor body shown in transparent view for clarity.
Figure 9:
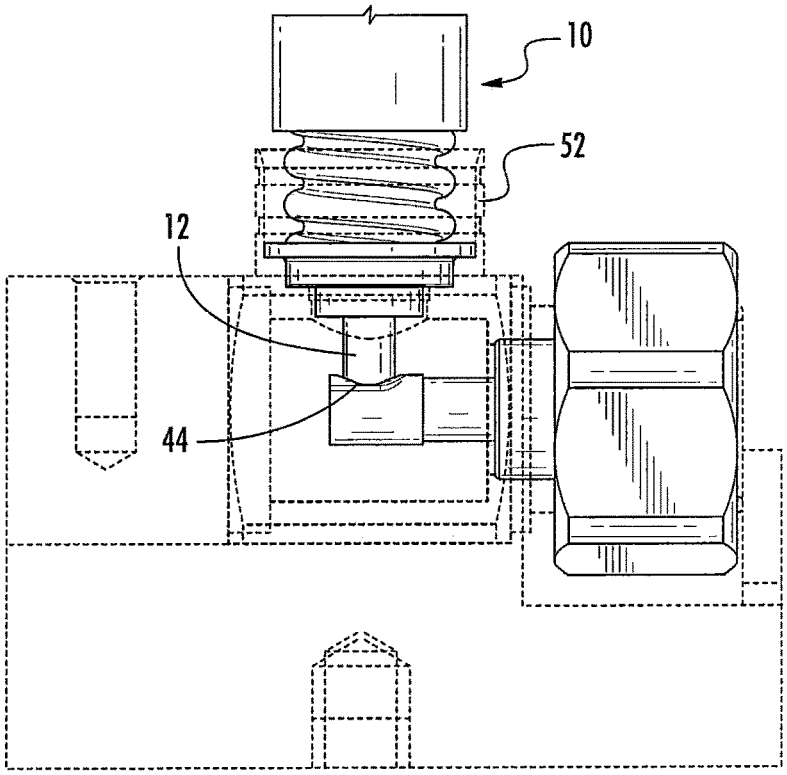
FIG. 9 is a side view as in FIG. 8 with the cable of FIG. 5 lowered into position for soldering.
Figure 10:
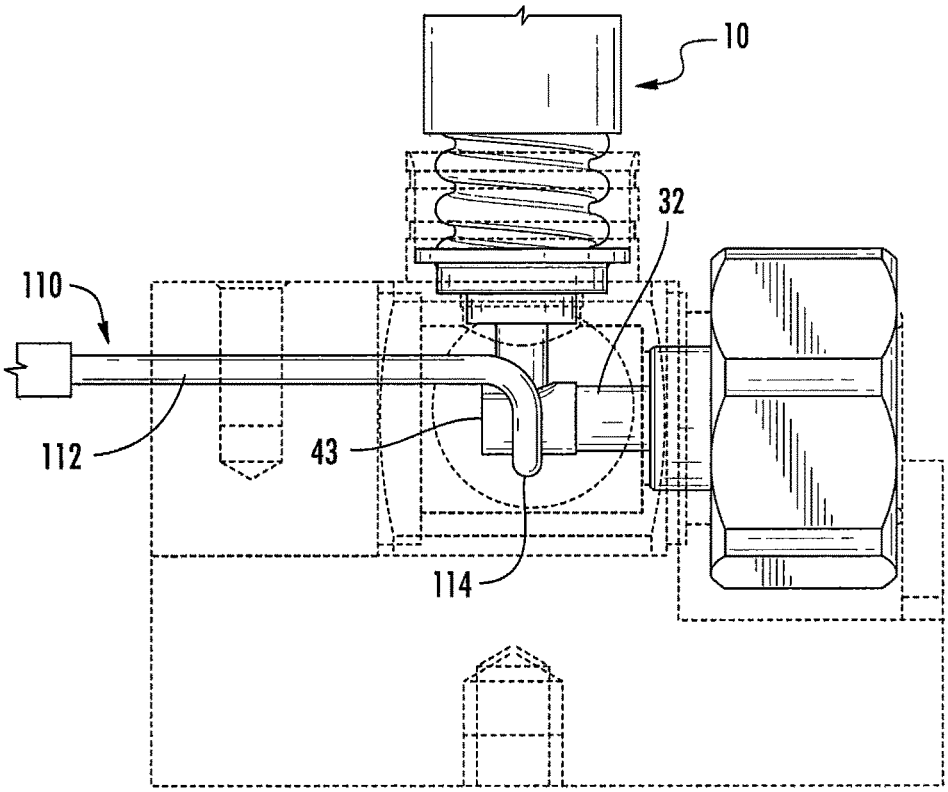
FIG. 10 is a side view as in FIG. 8 with the soldering element of the fixture of FIG. 6 moved into position for soldering.
Figure 11:
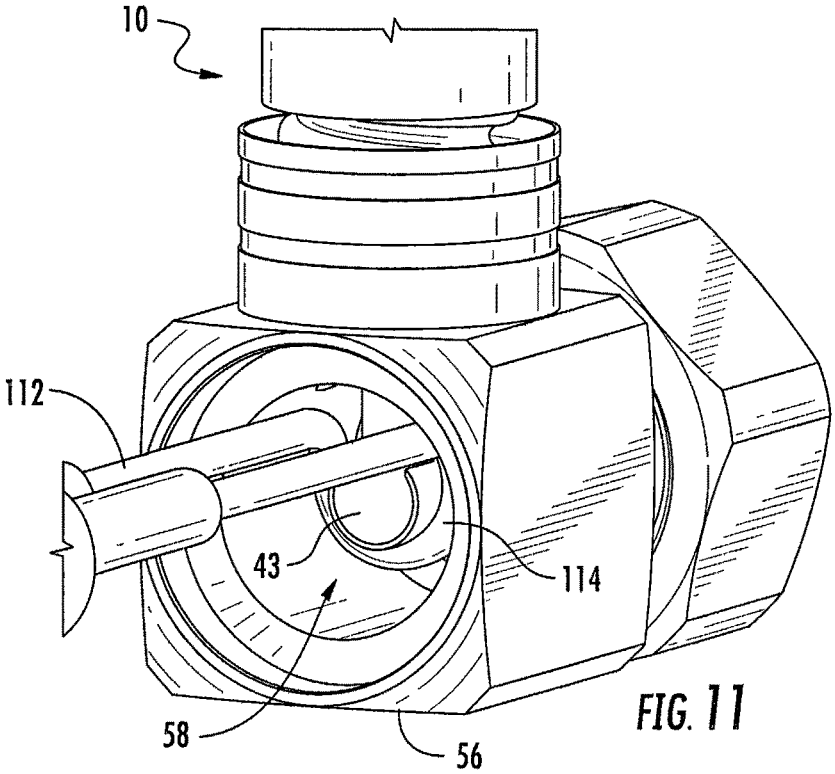
FIG. 11 is a perspective view of the soldering element of FIG. 10 in position for soldering.

Soldering of the solder joint between the inner conductor 12 and the contact block 43 of the inner conductor 32 is illustrated in FIGS. 6-11. A soldering fixture 100 includes a block 102 with a recess 104 configured to hold the outer conductor body 34 of a connector 30 and a flange 106 to assist with proper registration of the connector 30. An auto-induction soldering element 110 is positioned to the side of the block 102. As can be seen in FIGS. 7, 10 and 11, the soldering element 110 is an element of a loop circuit, including parallel straight segments 112 and arcuate segment 114. The parallel straight segment 112 is generally connected to the arcuate segment 114 perpendicularly. The soldering element 110 is mounted on an auto-induction soldering mobile unit 116 that is configured to move the soldering element 110 toward and away from the block 102.

To create a solder joint between the inner conductor 12 and the inner conductor 32, the blind hole 44 in the contact block 43 is first filled partially with solder paste. At this point the inner conductor 32 of the connector 30 is held in place by the dielectric 62. The connector 30 is positioned in the recess 104 so that the cable contact sleeve 52 faces upwardly and the hole 58 in the rear wall 56 faces the soldering element 110 (FIG. 8). The cable 10 is lowered through the cable contact section 52 so that the end of the inner conductor 12 is inserted into the blind hole 44 (FIG. 9).

The soldering element 110 is moved via the auto-induction soldering mobile unit 116 through the hole 58 (i.e., along the mating axis A) and into the position shown in FIGS. 10 and 11. The straight segments 112 of the soldering element 110 are positioned parallel to the inner conductor 32 and terminate on either side of the contact block 43. The arcuate segment 114 is positioned below the contact block 43. Heat is applied to the soldering element 110 to inductively melt the solder paste within the blind hole 44. A joint is formed when the melted solder paste freezes. The access hole 58 is then covered with a plug or the like (not shown).

Notably, the orientation of the cable 10 and connector 30 enable outgassing of solder as it melts and freezes. In some instances, as solder melts and freezes, bubbles can form in the joint, leaving voids in the joint that can negatively impact electrical properties of the joint (including PIM). Also, severe outgassing can cause the solder bubbles to burst and be deposited on the outer conductor body 34, which can also negatively impact electrical performance of the connector 30. The orientation of the blind hole 44 renders molten solder more likely to remain in the blind hole 44 rather than spilling out, and also allows vertical outgassing to occur.

Those of skill in this art will appreciate that, although the connector 30 is illustrated herein, a jack or other connector may be suitable for use with the concepts discussed above. Also, although a galvanic connection is anticipated between the connector 30 and a mating jack, the concepts may be employed with connectors designed for capacitive coupling (see, e.g., U.S. patent application Ser. No. 14/303,745, filed Jun. 13, 2014, the disclosure of which is hereby incorporated herein in its entirety).

Figure 12:
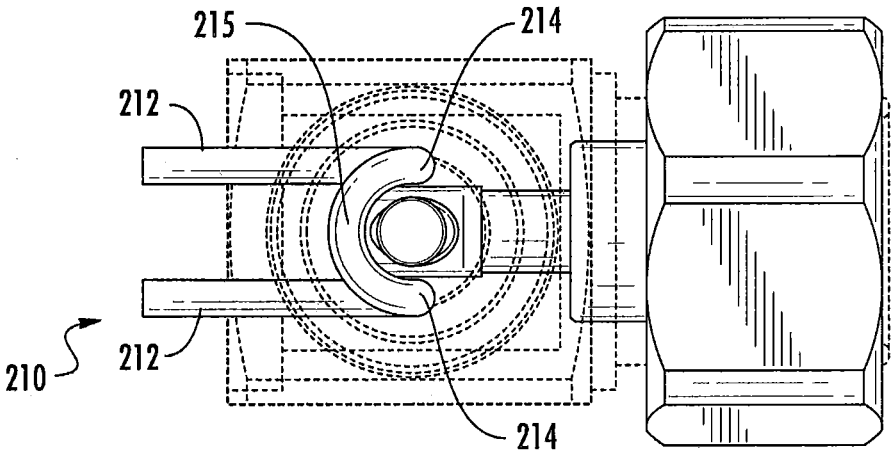
FIG. 12 is a top view of an alternative soldering element for use with the fixture of FIG. 6 with a cable lowered into position for soldering.
Figure 13:
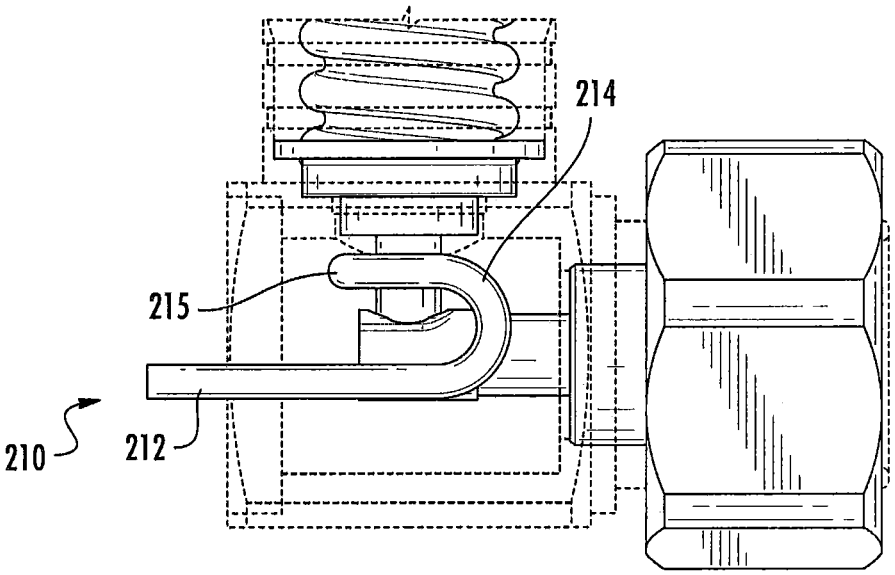
FIG. 13 is a side view of the soldering element of FIG. 12.
Figure 14:
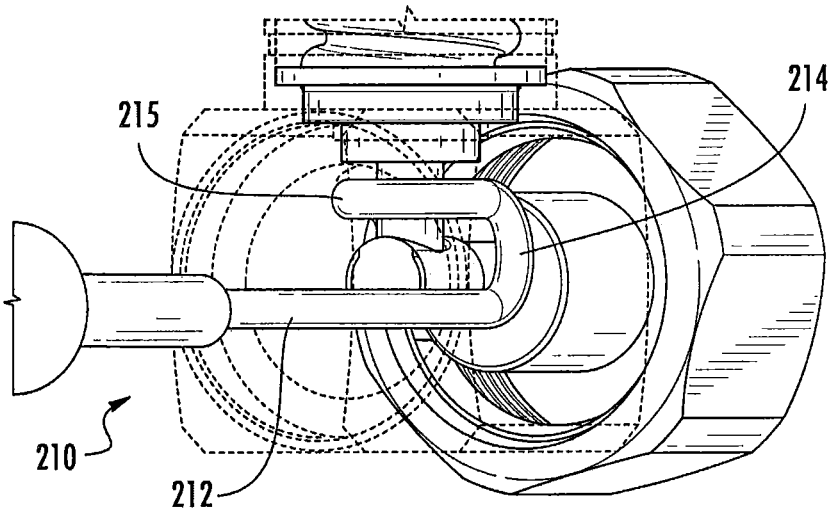
FIG. 14 is a front perspective view of the soldering element of FIG. 12.

An alternative induction soldering element is shown in FIGS. 12-14 and designated broadly at 210. The soldering element 210 includes two straight segments 212 that merge with two arcuate segments 214 that extend upwardly. An arcuate bridge segment 215 spans the ends of the arcuate segments 214.

As can be seen in FIGS. 12-14, when the soldering element 210 is moved into position in the manner described above for the soldering element 110, the ends of the straight segments 212 are located on either side of the contact block 43, the arcuate segments 214 extend upwardly therefrom, and the bridge segment 215 is positioned on the side of the inner conductor 12 away from the coupling nut 80. This configuration can heat the blind hole 44 in the contact block 43 to form a solder joint in the manner described above, but may be able to provide heat to the inner conductor 12 to enhance the soldering operation.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A method of soldering an inner conductor of a coaxial cable to an inner contact of a right angle coaxial connector, comprising the steps of:

(a) providing a coaxial connector, the coaxial connector including an outer conductor body and an inner contact, the inner contact defining a mating axis, the inner contact further comprising a blind hole with an open end;

(b) providing a coaxial cable, the coaxial cable including an inner conductor, a dielectric circumferentially surrounding the inner conductor, and an outer conductor circumferentially surrounding the dielectric;

(c) inserting the coaxial cable into the coaxial connector such that an end of the inner conductor is positioned in the blind hole of the inner contact, the inner conductor being substantially perpendicular to the mating axis; and (d) heating the blind hole of the inner conductor to melt solder present in the blind hole to form a solder joint between the inner conductor and the inner contact; wherein the heating step comprises heating the blind hole with an induction soldering element inserted into a hole in the outer conductor body; wherein the induction soldering element is inserted through the hole along an axis that is generally parallel with the mating axis.

2. The method defined in claim 1, wherein the inserting step comprises lowering the coaxial cable into the blind hole.

3. The method defined in claim 1, further comprising the step of positioning the coaxial connector in a fixture prior to step (c).

4. The method defined in claim 1, wherein the induction soldering element comprises two straight segments and an arcuate segment that is positioned below the blind hole.

5. The method defined in claim 1, wherein step (a) includes providing the coaxial connector with solder in the blind hole of the inner contact.

6. The method defined in claim 1, wherein the induction soldering element includes two straight segments, two upwardly extending segments, and a connecting segment that is positioned above the blind hole.

* * * * *